US005534086A

United States Patent [19]

Andrus

[11] Patent Number: 5,534,086

[45] Date of Patent: Jul. 9, 1996

[54] METHOD FOR MAKING A COBALT-BORIDE DISPERSION-STRENGTHENED COPPER

[75] Inventor: James S. Andrus, Palm Beach Gardens, Fla.

[73] Assignee: United Technologies Corporation, Hartford, Conn.

[21] Appl. No.: 432,061

[22] Filed: May 1, 1995

Related U.S. Application Data

[62] Division of Ser. No. 170,932, Dec. 21, 1993, Pat. No. 5,435,828.

[51] Int. Cl.[6] ..... B22F 3/02; B22F 9/08; C22F 1/08

[52] U.S. Cl. ..... 148/513; 75/334; 75/338; 164/46; 419/12; 419/68

[58] Field of Search ..... 75/334, 338; 148/512, 148/513; 164/46; 419/12, 23, 67, 68

[56] References Cited

U.S. PATENT DOCUMENTS

| | | | |
|---|---|---|---|
| 2,183,592 | 12/1939 | Silliman | 420/469 |
| 3,128,172 | 4/1964 | Wagner et al. | 420/469 |
| 3,573,110 | 3/1971 | Ence | 148/411 |
| 3,640,779 | 2/1972 | Ence | 148/411 |
| 4,110,892 | 9/1978 | Bangay et al. | 419/67 |
| 4,372,789 | 2/1983 | Jackson | 148/404 |
| 4,395,464 | 7/1983 | Panchanathan et al. | 419/12 |
| 4,505,878 | 3/1985 | Childs et al. | 419/67 |
| 4,710,348 | 12/1987 | Brupbacher et al. | 420/129 |
| 4,749,548 | 6/1988 | Akutsu et al. | 420/469 |
| 4,818,283 | 4/1989 | Grünthaler et al. | 75/338 |
| 4,865,645 | 9/1989 | Planchamp | 75/244 |

FOREIGN PATENT DOCUMENTS

| | | | |
|---|---|---|---|
| 61-177303 | 8/1986 | Japan | 75/338 |
| 5-140678 | 6/1993 | Japan . | |

OTHER PUBLICATIONS

V. K. Sarin & N. J. Grant, *Powder Metallurgical Cu–Zr and Cu–Zr–Cr Alloys,* Powder Metallurgy International, vol. 11, No. 4, pp. 153–157, 1979.

V. K. Sarin & N. J. Grant, *Cu–Zr and Cu–Zr–Cr Alloys Produced from Rapidly Quenched Powders,* Metallurgical Transactions, vol. 3, pp. 875–878, Apr. 1972.

*Primary Examiner*—George Wyszomierski

*Attorney, Agent, or Firm*—Popham, Haik Schnobrich & Kaufman, Ltd.

[57] ABSTRACT

A dispersion-strengthened copper alloy is disclosed having an exceptional combination of strength, ductility, and thermal conductivity. The copper alloy comprises: copper, 0.01 to 2.0 weight % boron and 0.1 to 6.0 weight % cobalt, and cobalt-boride disperoids that range in size between 0.025 and 0.25 microns in diameter. A copper alloy is made by rapid solidification of the melt into a powder. Strong, thermally conductive articles can be made by compacting the powder at temperatures below the melting temperature of the copper alloy, and optionally warm working, cold working, and annealing.

15 Claims, No Drawings

METHOD FOR MAKING A COBALT-BORIDE DISPERSION-STRENGTHENED COPPER

This invention was made under United States Government Contract NAS 3-23858, and the United States Government has rights therein.

This is a divisional of U.S. patent application Ser. No. 08/170,932, filed Dec. 21, 1993, now U.S. Pat. No. 5,435,828.

FIELD OF THE INVENTION

The present invention relates to copper alloys comprising 0.01 to 2.0 weight percent boron and 0.1 to 6.0 weight percent cobalt. The present invention also relates to methods of making cobalt-boride dispersion-strengthened copper alloys via the rapid solidification of a melt comprising copper, cobalt and boron.

INTRODUCTION

A challenge to researchers in the material sciences is to create materials that meet the rigorous demands posed by developments at the forefront of technology. Various components for use in the aerospace industry, such as regeneratively cooled thrust chambers for liquid rocket engines and high heat-flux panels for hypersonic aircraft engine and air frame surfaces, require materials having high strength and high thermal conductivity at high temperatures. Ductility, compatibility with hydrogen, and resistance to softening during brazing are also desirable. While materials meeting these requirements may be particularly well-suited for applications in advanced technologies, they can also be expected to find beneficial uses in conventional areas of technology, especially where good strength and high conductivity are required.

Copper is known to be among the most thermally conductive materials. However, the relatively poor strength and low durability of copper preclude its use in situations where good strength at high temperature is a requirement. Solution strengthening additions to copper are not desirable in the present invention because, except for silver, they lower conductivity. Methods of hardening copper by precipitation hardening are known, with the most beneficial additions having been found to be silver, chromium, zirconium, hafnium, and beryllium. These elements promote precipitation of small amounts of strengthening phases. However, since they are all soluble in copper at elevated temperature, their use begins to be limited at 900° F. Also, precipitation strengthening is frequently incompatible with brazing, when the material must be slowly cooled from high temperature, resulting in overaging.

The cobalt-boride dispersion-strengthened copper alloy of the present invention avoids these disadvantages and provides a new material that combines thermal conductivity with good strength at high temperature.

BACKGROUND

Dispersions have long been known to strengthen various alloys and there are a variety of methods for forming dispersion-strengthened alloys. The methods typically use powder metallurgy. Early work in dispersion-strengthened alloys produced thoria-dispersed nickel via precipitation of powders from aqueous solutions. Another early alloy, sintered aluminum power, made dispersion-strengthened aluminum alloys from a slightly oxidized fine aluminum powder.

Internal oxidation is another technique for producing dispersion-strengthened alloys. Oxide dispersion-strengthened platinum and silver are commercially produced from solutions of the noble metal and a reactive element such as aluminum or zirconium. Oxidation and compaction results in a noble metal with a dispersed oxide such as alumina or zirconia.

Commercially produced dispersion-strengthened alloys, particularly nickel and aluminum alloys, have also been made by mechanical alloying. In this process, powdered forms of the matrix and dispersoids are mixed in a ball mill, wherein the balls pound the particulates thin and then weld them together, thereby mixing the dispersoids into the alloy matrix. Mechanical alloying of copper has not been commercialized, perhaps due to the fact that copper welds easily and adequate size reduction has not been obtained.

Another, more recent, method of making dispersion-strengthened metal alloys involves rapid solidification of alloys from a melt. Rapid solidification has been found to produce extremely fine microstructures in metals. In this technique, dispersion-forming constituents are dissolved in a molten alloy. During rapid solidification, these constituents precipitate as fine uniformly dispersed particulates within the alloy. Examples of the few thermally stable dispersion-strengthened alloys prepared by rapid solidification include $FeAl+TiB_2$ (U.S. Pat. No. 4,419,130) and Al-Fe-Ce (See J. L. Walter et al., Eds. Alloying, ASM Int'l., p. 193, 1988). Many other systems have looked promising, but have proven unstable, primarily due to diffusion of the dispersion-forming elements at elevated temperature. Rapidly solidified dispersion-strengthened copper alloys have been studied by Sarin and Grant. See V. K. Sarin et al., Met. Trans., Vol. 3, pp. 875–878, 1972; and V. K. Sarin et al., *Powder Metallurgy Int'l.*, Vol. 11, No. 4, pp. 153–157, 1979. The dispersions contained in these alloys were formed by reaction between reactive additives (chromium and zirconium) and oxygen contamination. All references cited herein are incorporated by reference as if set forth in full below.

Thus far, only internal oxidation has found commercialized use in a method for producing dispersion-strengthened copper alloys. One such alloy is "GLIDCOP" which is available from SCM Metal Products, Inc. This alloy contains finely dispersed aluminum oxide particles that are produced by internal oxidation. This alloy exhibits very high strength capabilities, but it is difficult to make cleanly, since the copper itself is partially oxidized. To remove the oxidized copper, the powder must be reduced after the internal oxidation step. This is difficult to do uniformly, since some copper oxide can become entrapped and hence will not outgas when reduced. Articles made from alumina dispersed copper alloys have exhibited some undesirable properties, including: microstructural inhomogeneity, reactivity with hydrogen, and hot shortness (brittleness at high temperature).

SUMMARY OF THE INVENTION

The cobalt-boride dispersion-strengthened copper alloys of the present invention are made by rapidly solidifying a molten solution of copper, cobalt, and boron into a fine powder or ribbon. The rapid solidification (a cooling rate of at least 10,000° F./second) produces a fine dispersion of cobalt-boride in the copper matrix. The fine alloy particles are consolidated into a bulk-form article at temperatures well below the melting point using a solid state compaction process. Extrusion, hot isostatic pressing, and hot vacuum compaction are preferred compaction processes. The temperature is controlled to prevent coarsening of the dispersion. The bulk form may then be hot- or cold-worked to develop desired mechanical properties and physical shapes. The copper alloy of the present invention contains 0.01 to 2.0 weight percent boron and 0.1 to 6.0 weight percent cobalt.

Boride dispersions offer many advantages. Unlike oxide dispersions, they are well-suited to this process, since boron can be added controllably to the copper melt. Borides exhibit high thermal stability. In fact, the most thermally stable borides (e.g., titanium diboride, zirconium diboride, hafnium diboride) are so stable that they have been found to form as coarse particulates in the melt at high superheats, instead of forming upon solidification. It is a discovery of the present invention that cobalt borides can be dissolved in the copper melt, yet form as fine dispersions upon rapid solidification, and remain finely dispersed upon exposure to solid state processing temperatures up to 1700° F.

It is preferred that the cobalt-boride particles in the alloy be no larger than 0.25 microns in diameter, and more preferably no larger than 0.1 microns in diameter. While a small number of somewhat larger particles can be tolerated, a copper alloy with a significant number of larger particles is clearly undesirable.

The lower size limit of the cobalt-boride dispersion particles has not been studied in great detail; however, it is contemplated that in order to obtain desired strength properties, the alloy contain dispersion particles no smaller than about 0.025 microns and ideally about 0.05 microns. The presence of smaller cobalt-boride particles can be tolerated in small amounts in less preferred embodiments of the present invention.

In other preferred embodiments, the alloy of the present invention exhibits the following properties:

Grain size: either equiaxed, very fine grains (less than 10 microns in diameter); or Large high-aspect ratio grains (aspect ratio greater than 4, length greater than 100 microns); and Thermal conductivity: greater than 190 Btu/ft, hour, ° F. at 1,000° F.

Preferred alloys of the present invention exhibit microstructural stability at temperatures up to 1,700° F. and are not affected by exposure to hydrogen gas at pressures up to 3,000 psi and temperatures up to 1,400° F.

Remelting and recasting of the dispersion-strengthened copper alloy must be avoided. At low melt temperatures, the dispersed phase will coalesce and coarsen in the melt and be present as coarse particles upon solidification. Also at low melt temperatures, the dispersion will occasionally segregate so that an inhomogeneous alloy would form during subsequent solidification. At high melt temperatures, the dispersion will dissolve and large boride particles will precipitate when the alloy is solidified slowly.

Articles formed from the cobalt-boride dispersion-strengthened copper alloy of the present invention can be used at temperatures from −320° F. to 1200° F. The alloy is especially useful in situations where good strength, ductility, cyclic plasticity, and long-time stability is required at temperatures from 800° F. to 1200° F. The alloy is particularly outstanding for use in situations requiring low creep rates at low stresses at temperatures from 1000° F. to 1200° F.

Copper alloy articles of the present invention are useful as individual components and are especially useful in brazed assemblies. Specific uses contemplated for the alloy of the present invention include: high heat-flux heat exchangers, regeneratively cooled thrust chambers for liquid fueled rocket engines, and actively cooled high heat-flux panels for hypersonic aircraft engine and airframe surfaces. Other contemplated uses include uses as components in particle accelerators, electronics, and resistance welding electrodes.

While the present invention has been described above, certain, preferred embodiments can be better understood by the following detailed description. Percentages and parts per million (ppm) refer to weight unless otherwise indicated.

DETAILED DESCRIPTION OF THE INVENTION

The Cu-Co-B powder alloy of a preferred embodiment of the present invention is made by rapid solidification rate rotary atomization. The apparatus used is described in U.S. Pat. No. 4,025,249 and consists of a vacuum chamber containing an induction melter, an induction heated metering tundish and nozzle, and an atomizer disk turning at greater than 30,000 rpm. The alloy is melted in the induction melter and poured into the metering tundish, from which it flows through the metering nozzle onto the rotating disk. The fluid is accelerated to the edge of the disk and atomized into droplets from the edge into a helium atmosphere in which the droplets solidify into roughly spherical alloyed powder particles. These are captured at the bottom of the chamber.

For this particular alloy, high-purity oxygen-free copper (C10100 or C10200) bars are charged into a graphite induction melting crucible (graphite helps to heat the charge by coupling with the induction field, helps to minimize oxidation of the melt, and withstands the superheats needed). The device is closed and evacuated to 0.25 torr. The charge is melted and superheated to at least 2800° F., then crushed electrolytic cobalt (99.9% pure) and crushed boron granules (99.5% pure) are added as late additions. Meanwhile, the tundish and metering nozzle assembly, also made of graphite, are heated as hot as possible (at least 2100° F. at the nozzle, up to the temperature of the melt). When the melt and the tundish/nozzle assembly have reached the proper temperatures, the device is backfilled with helium to 800 torr (absolute pressure) and the 4 inch diameter atomizer disk is rotated in excess of 33,000 rpm. The melt is poured into the tundish, from which it pours through the nozzle orifice (0.200" to 0.300" diameter) onto the atomizer disk. The resultant powder is collected in metal bottles attached to the bottom of the chamber. These bottles are closed via interconnecting valves and removed from the chamber. The bottles are connected to and drained into helium purged glove boxes, where the powder is screened into different size fractions, it being preferable to use powder finer than 50 microns in diameter since it solidifies faster.

The powder can be compacted into solid forms in several different ways, all producing 100% dense, ductile forms.

The powder can be hot extruded into a bar. First, it is transferred into a leak-free copper extrusion can via the glove box. The filled can (billet) is then attached to a vacuum pump to extract the air, helium, and other gasses within. It is helpful to heat the billet in the later part of the outgassing operation to bake out the billet—a temperature of 800° F. is satisfactory. Time is dependent on the size of the billet. The extrusion can is sealed (usually by crimping the tube through which it was filled). Then, it is heated to 1200° F. for a time appropriate for its size, and hot extruded through a conical die at an extrusion ratio of at least 10:1. If desired, the extruded bar may then be swaged, drawn, annealed, etc. Extrusion, by itself, produced the highest strength bars.

The powder can be hot isostatic pressed (HIPed) into a block or other form. First, it is transferred into a leak-free steel HIP can via the glove box. The filled can (billet) is then attached to a vacuum pump to extract the air, helium, and gasses within. It is helpful to heat the billet in the later part of the outgassing operation to bake out the billet—a temperature of 800° F. is satisfactory. Time is dependent on the size of the billet. The HIP can is sealed (usually by crimping the tube through which it was filled). It then can be HIPed at 1500° F./20,000 psi (for a soak time appropriate for its size). The steel can may be machined off. If desired, the HIP-consolidated material then may be extruded, forged, rolled, or subjected to other forming operations. The material may be hot rolled at 1200° F. to 1600° F. After being broken down, the material can be cold rolled.

Variations on the above include:

Use of other crucible or tundish materials, including yttria-stabilized zirconia.

Backfill atomizer before melting is complete, in order to reduce evaporation of copper.

Use of melt temperatures of 2700° F. to 4000° F.

Use of tundish temperatures of 2100° F. to 4000° F.

Use of atomizer speeds of 20,000 to 50,000 rpm.

Use of atomizer disk diameters of 2" to 8".

Use of other inert or reducing gases in place of helium.

Use of nozzle diameters of 0.1" to 0.5".

Use of coarser or finer powder size distributions.

Use of other rapid solidification rate particulate making processes such as gas atomization or melt spinning.

Use of vacuum hot compaction for consolidation.

Use of extrusion and HIP temperatures of 1000° F. to 1700° F.

Use of extrusion ratios of 4:1 to 40:1.

Use of HIP pressures of 5,000 to 30,000 psi.

Use of steel, nickel, stainless steel, or copper extrusion or HIP cans.

The rapid solidification of alloys by rotary atomization is well known. Background information regarding rotary atomization is available in publications such as U.S. Pat. Nos. 4,226,644, 5,015,534, and 4,889,582; which are incorporated by reference herein.

EXAMPLES

Example 1

A 120 pound charge of 3" diameter C10100 copper bars was placed into a 9" internal diameter graphite induction melting crucible. The device was closed and evacuated to 0.25 torr. The charge was melted and heated to 2840° F., then crushed electrolytic cobalt (99.9% pure) and crushed boron granules (99.5% pure) were added as late additions, to make a target composition of Cu-2.4% Co-0.7% B. Meanwhile, the tundish and metering nozzle assembly (nozzle diameter 0.190"), also made of graphite, were heated to 2160° F. (at the nozzle). When the melt and the tundish/nozzle assembly reached the proper temperatures, the device was backfilled with helium to 800 torr and the 4" diameter atomizer disk turned on, to rotate at 35,000 rpm. The melt was atomized. The resultant powder had a composition of Cu-2.5% Co-0.7% B, 80 ppm oxygen, 260 ppm carbon. Of this, 64% of the powder was finer than 50 microns in diameter.

Example 2

Another, larger (200 pound), heat was made with an aim composition of Cu-2.1% Co-0.6% B and an analyzed composition of Cu-2.3% Co-0.6% B, 190 ppm oxygen, 600 ppm carbon. The same procedure was followed, except that melt temperatures and nozzle temperatures were higher (2900° F. and 2400° F., respectively) and a larger nozzle diameter was used (0.250").

Example 3

An extrusion was made from the powder of Example 1, screened to 50 microns or less. A welded deoxidized copper can 2.9" in outside diameter by 7" long, internally 2.5" diameter by 5.5 inches long, was filled with about 5 pounds of powder inside the glove box via a 0.5" copper filler tube welded to one end, then a valve was attached and closed. The valve was attached to a vacuum pump and opened. The billet was evacuated for two hours cold, then heated to 800° F. and evacuated another two hours. The filler tube was crimped. The billet was covered with a graphite lubricant and heated for 2 hours in an air furnace at 1200° F. It was then extruded from a 3" diameter liner through a 0.68" diameter conical die.

Example 4

A similar extrusion to that of Example 3 was made, only to a larger diameter, 0.84." It was then cold swaged to 75% reduction in area, using die steps of about 13% reduction in area.

Example 5

A HIP billet was made from the first lot of powder (Example 1), screened to 50 microns and finer. A rectangular welded steel can about 6" by 6" by 2", with 0.12" thick walls and a 0.5" diameter nickel filler tube was filled with about 11 pounds of powder inside the helium glove box, then a valve was attached and closed. The valve was attached to a vacuum pump and opened. The billet was evacuated for two hours cold, then heated to 800° F. and evacuated another two hours. The filler tube was crimped. The billet was HIPed at 1500° F. and 20,000 psi for 4 hours. The steel can was machined off.

The HIP billet was cut into pieces. One was warm rolled at 1200° F., from about 1.25" to 0.1" thick (92% reduction in thickness), at about 15% reduction per pass. Another piece was warm rolled at 1200° F. to 0.4" thick (70%), then cold rolled to 0.1" (75% cold). Still another piece was warm rolled to 0.4", then repeatedly cold rolled 25%+ annealed (30 minutes at 1200° F. in air) for five times, then cold rolled an additional 25% to a final thickness of 0.050". The latter sheet exhibited the highest strength at 1000° F.

TABLES

Numerous applications for this alloy require brazing in the fabrication process. Brazing usually softens copper alloys to very low strength levels. Tables 1 and 2 illustrate the superior strength properties of the alloys of the present invention as compared with copper alloys of the prior art when annealed to simulate a braze. For example, bar forms of Cu-2.5% Co-0.7% B exhibit a yield strength of 13.7 ksi at 1200° F. as compared with yield strengths 9.6 and 8.4 ksi for Cu-1.2% Cr-0.9% Zr and Cu-2.6% Hf-1.0% Cr respectively.

Table 3 illustrates the excellent thermal conductivity of an alloy of the present invention, Cu-2.5% Co-0.7% B, which exhibits conductivities at 75° F. and 1000° F. that approach those of pure copper.

Table 4 illustrates the superiority of rapidly solidified Cu—Co—B compared to conventional cast Cu—Co—B. Casting (i.e. slow solidification of) alloys having the elemental composition of alloys of the present composition produces extremely large dispersed particles, and results in a relatively weak article. For example, casting and working a Cu-3.1% Co-0.7% B alloy bar results in a tensile strength of 9.4 ksi at 1200° F. as compared with 17.4 ksi for a bar made by hot extrusion of the rapidly solidified powdered alloy of the present invention.

Details regarding the specimens and testing conditions reported in the tables as well as citations of appropriate references, are presented below.

Table 1

Preparation process: all alloys were vacuum melted and rotary atomized in helium into rapidly solidified powder. The Cu—Co—B alloy was atomized from a melt at 2840° F. and poured through a 0.190" diameter nozzle. The other two alloys were atomized from melts at 2200° F. and poured through 0.25" diameter nozzles. All were melted in graphite crucibles, and poured through graphite nozzles onto 4" diameter atomizer disks rotating at 35,000 rpm. Powders were sized by screening, encapsulated in evacuated copper cans, then extruded at 1200° F./22:1 extrusion ratio (reduction in cross-sectional area). The powder size fraction used for the Cu—Co—B alloy was that less than 50 microns in size; for the other two alloys, the powder fractions used were those less than 180 microns. The extruded bars were then heat-treated in a vacuum furnace: heated to 1700° F., held for one hour, cooled under vacuum at approximately 10° F. per minute to about 300° F. (furnace cool), and then removed.

Testing

Specimens: bars were machined into round tensile specimens. All specimens had 0.25" diameter by 1" long gauges, 0.5" diameter threaded grips, and 0.25" radius shoulders.

Testing: all tests were preformed at 1200° F. on a hydraulically loaded tensile testing machine, in air. Specimens were heated by a resistance heated tube furnace attached to the tensile test machine. Strain rates were approximately 0.005/minute to yield, and then 0.05/minute to failure. Strains (for yield strength) were determined by extensometers attached to the specimen gauges. Elongation was measured over an initial gage length of 1" (4 times the gauge diameter).

Table 2

Preparation process: The Cu—Co—B and Cu—Hf—Cr alloys were made from powder as described above. These powders (same size fractions) were encapsulated in rectangular steel cans (each holding about 11 pounds) which were evacuated and sealed. The cans were hot isostatic pressed (HIPed) at 1500° F. for 4 hours at 20,000 psi. After HIPing, the cans were removed by machining.

The Cu—Co—B alloy was rolled into sheet by first warm rolling 70% at 1200° F., then five cycles of cold rolling 25%+ annealing 30 minutes at 1200° F. in air, then cold rolling an additional 25% to a final thickness of 0.050" (for rolling, all % denote reduction in thickness).

The Cu—Hf—Cr alloy was rolled into sheet by first hot rolling 70% at 1500° F., pickling in nitric acid, cold rolling 60%, annealing one hour in vacuum at 1700° F. (cooling at 60° F./minute), and then cold rolling an additional 15% to a final thickness of 0.085".

The Cu—Ag—Zr alloy was made by vacuum induction melting C10100 copper to 2300° F., adding fine silver and zirconium, and casting into a 4" diameter copper mold. The resulting ingot was machined into a round cylinder (3.4" diameter by 4.4" high) and then isothermally upset at 1500° F. to a 0.7" thick pancake. Next, it was rolled into sheet by first hot rolling 65% at 1550° F., pickling in nitric acid, cold rolling 45%, and then solutioning and aging (1700° F. for one hour in vacuum, then 900° F. for two hours in vacuum). Final thickness, 0.100".

The above descriptions represent optimum processing sequences found for each alloy. After rolling into sheet, all were heat-treated in a vacuum furnace: heated to 1700° F., held for one hour, cooled under vacuum at approximately 10° F. per minute to about 300°, and then removed.

Testing

Specimens: sheets were machined into flat tensile specimens. All specimens had 0.20" wide by 0.8" long gauges (thickness as-rolled), overall size of the specimens was 0.75" wide by 3.5" long. Specimens contained 0.25" diameter holes in the grips for pin loading.

Testing: all tests were performed at 1000° F. On a hydraulically loaded tensile testing machine, in air. Specimens were heated by a resistance heated tube furnace attached to the tensile test machine. Strain rates were approximately 0.005/minute to yield, and then 0.05/minute to failure. Strains (for yield strength) were determined by extensometers attached to the specimen grips. Elongation was measured over an initial gage length of 0.80" (four times the gauge width).

Table 3

The Cu—Co—B, Cu—Zr—Cr, and Cu—Hf—Cr alloys were prepared as for Table 1. Thermal conductivities were measured on extruded bar using the laser flash thermal diffusivity method. Specimen size was 0.5" diameter by 0.25" long.

The values for copper were taken from the literature. Material pedigree and test method are not known. Esposito, J. J., and Zabora, R. F., *Thrust Chamber Life Predictions,* Vol. 1: Mechanical and Physical Properties of High Performance Rocket Nozzle Materials, Boeing Aerospace Company, March 1975, NASA CR134806.

The values for Cu-0.15% Zr were taken from the literature. The material was described as extruded at 1760° C. and then aged at 790° C. Test method was thermal conductivity by thermal gradient measurement. Siu, M.C.I., et al., *Thermal Conductivity and Electrical Resistivity of Six Copper-base Alloys,* National Bureau of Standards, March 1976, NBSIR 761003.

The values for Cu-0.8% Cr came from a manufacturer's brochure. "AMCHROM Brand Copper," AMAX Copper, New York, 1983. Material pedigree and test method are not known.

The values for the Cu—Cr—Zr—Mg alloy are averaged data from two sources. One was a manufacturer's brochure "AMAX MZC Copper Alloy," AMAX Copper, New York, 1983. (hot-worked and aged; unspecified test technique). The other was a NBS report (see Siu et al., above) for which the material was described as solutioned at 1580° F., cold drawn and aged at 930° F. for 2.5 hours and then drawn. Test method was thermal conductivity by thermal gradient measured along a bar.

The values for Cu—Ag—Zr alloy came from the literature (Fulton, D., *Investigation of Thermal Fatigue in Non-Tubular Regeneratively Cooled Thrust Chambers,* Vol. 1, Rockwell International Corp. May 1973, AFRPL-TR-73-10). The material was hot-worked, solutioned and aged. Test method was laser flash diffusivity.

Table 4

Preparation process: the powder Cu—Co—B alloy was processed into extruded bar as described for. Table 1. The ingot process Cu—Co—B alloy was made by vacuum induction melting C10100 copper, boron and cobalt to 2700° F., and then casting into a 4" diameter copper mold. The resulting ingot was machined to a 3" diameter cylinder, extruded at 1500° F./14:1 extrusion ratio, and then warm-swaged to a 50% reduction in area at 1200° F.

Testing: all tests were performed at 1000° F. and 1200° F. on a hydraulically loaded tensile testing machine, in air. Specimens were heated by a resistance heated tube furnace attached to the tensile test machine. Strain rates were approximately 0.005/minute to yield, and then 0.05/minute to failure. Stains (for yield strength) were determined by extensometers attached to the specimen gauges. Elongation was measured over an initial gauge length of 1" (4 times the gauge diameter).

Although the invention has been described in conjunction with specific embodiments, it is evident that many alternatives and variations will be apparent to those skilled in the art in light of the foregoing description. For instance, equivalent means could be employed for making the fine, cobalt-boride dispersion-strengthened copper alloy particles. In another variation, Silver additions (up to 3%) could be used to increase low-temperature (<800° F.) strength and creep resistance. Accordingly, the invention is intended to embrace all of the alternatives and variations that fall within the spirit and scope of the appended claims.

TABLE 4

Effects of Solidification Rate: Elevated temperature properties of slowly solidified (ingot-processed) Cu—3.1%Co—0.7%B alloy bar and rapidly solidified (powder processed) Cu—2.5%Co—0.7%B alloy bar:

| Process | Test Temperature | Tensile Strength, ksi | Yield Strength, ksi | Elongation, % | Reduction of Area, % |
|---|---|---|---|---|---|
| Ingot | 1200° F. | 9.4 | 9.0 | 34 | 67 |
| Powder | 1200° F. | 17.4 | 15.3 | 27 | 80 |
| Ingot | 1000° F. | 13.6 | 11.6 | 27 | 62 |
| Powder | 1000° F. | 25.3 | 24.5 | 23 | 65 |

I claim:

1. A method of making a strengthened copper alloy comprising the steps of:

a) forming a melt comprising copper and 0.01 to 2.0 weight % boron and 0.1 to 6.0 weight % cobalt; and b) rapidly solidifying said melt at a rate of at least 10,000° F./second to obtain a copper powder having cobalt boride particulate dispersed therein;

c) compacting and warm working said powder to form a warm worked piece; and d) repeatedly cold rolling and annealing said piece.

TABLE I

Properties of bar forms of alloys made by hot extrusion, followed by a simulated braze (anneal):

| Alloy | Test Temperature | Tensile Strength, ksi | Yield Strength, ksi | Elongation, % | Reduction of Area, % |
|---|---|---|---|---|---|
| Cu—2.5%Co—0.7%B | 1200° F. | 14.0 | 13.7 | 28 | 71 |
| Cu—1.2%Zr—0.9%Cr | 1200° F. | 9.7 | 9.6 | 45 | 95 |
| Cu—2.6%Hf—1%Cr | 1200° F. | 8.7 | 8.4 | 60 | 96 |

TABLE 2

Properties of sheet forms of alloys made by HIPing and rolling followed by a simulated braze (anneal):

| Alloy | Test Temperature | Tensile Strength, ksi | Yield Strength, ksi | Elongation, % |
|---|---|---|---|---|
| Cu—2.5%Co—0.7%B | 1000° F. | 18.0 | 15.2 | 10 |
| Cu—3%Ag—0.5%Zr | 1000° F. | 16.3 | 8.4 | 23 |
| Cu—2.6%Hf—1%Cr | 1000° F. | 16.8 | 8.0 | 46 |

TABLE 3

Comparisons with other alloys - thermal conductivities, (Btu/ft, hr, °F.):

| Alloy | Conductivity at 75° F. | Conductivity at 1000° F. |
|---|---|---|
| Copper | 224 | 210 |
| Cu—0.15%Zr | 215 | 208 |
| Cu—2.5%Co—0.7B | 208 | 200 |
| Cu—3%Ag—0.5%Zr | 190 | 200 |
| Cu—0.15%Zr—1%Cr—0.06%Mg | 190 | 190 |
| Cu—0.8%Cr | 190 | 150 |
| Cu—1.2%Zr—0.9%Cr | 175 | 185 |
| Cu—2.6%Hf—1%Cr | 175 | 185 |

2. The method of claim 1 wherein said melt comprises: 0.01 to 2.0 weight % boron, 0.1 to 6.0 weight % cobalt, the remainder copper, and less than 600 ppm by weight carbon, less than 300 ppm by weight oxygen, and less than 500 ppm of all other elements.

3. The method of claim 2 wherein said melt is formed at between 2700° F. and 4000° F.

4. The method of claim 2, wherein said compacting step is performed at a temperature between 1000° and 1700° F.

5. The method of claim 4 wherein said step of compacting comprises a process selected from the group consisting of extruding, vacuum compacting, and hot isostatic pressing.

6. The method of claim 4 wherein said melt comprises 0.2 to 1.0 weight of % boron and 2.0 to 3.0 weight % cobalt.

7. The method of claim 4 wherein the powder utilized in said step of compacting consists of particles of less than 50 microns in size.

8. The method of claim 2 wherein said forming step comprises superheating said melt to at least 2800° F.

9. The method of claim 8 wherein said annealing is conducted at about 1200° F.

10. The method of claim 8 wherein said solidifying step comprises cooling by rotary atomization to form a powder.

11. The method of claim 1 wherein said annealing is conducted at about 1200° F.

12. The method of claim 11 wherein said step of compacting and warm working comprises hot isostatic pressing and warm rolling at about 1200° F.

13. A method of making a copper alloy comprising the steps of:

a) forming a melt comprising copper and 0.01 to 2.0 weight % boron and 0.1 to 6.0 weight % cobalt, the remainder copper, and less than 600 ppm by weight carbon, less than 300 ppm by weight oxygen, and less than 500 ppm of all other elements; and b) rapidly solidifying said melt at a rate of at least 10,000° F./second to obtain a copper powder having cobalt boride particulate dispersed therein; wherein step (a) comprises heating copper in a graphite crucible to a temperature of at least 2800° F., adding cobalt and boron; and wherein step (b) comprises pouring said melt onto an atomizer disk rotating at speeds of from 20,000 to 50,000 rpm, and thus forming a powder.

14. The method of claim 1 wherein said material in step (b) is cooled at a rate of at least 100,000° F./second.

15. The method of claim 13 further comprising a step selected from the group consisting of forging, hot rolling, and cold rolling.

* * * * *